US012000165B2

(12) United States Patent
Frerich

(10) Patent No.: US 12,000,165 B2
(45) Date of Patent: Jun. 4, 2024

(54) UMBRELLA BASE APPARATUS

(71) Applicant: Douglas Frerich, Irving, TX (US)

(72) Inventor: Douglas Frerich, Irving, TX (US)

( * ) Notice: Subject to any disclaimer, the term of this patent is extended or adjusted under 35 U.S.C. 154(b) by 162 days.

(21) Appl. No.: 17/678,338

(22) Filed: Feb. 23, 2022

(65) Prior Publication Data

US 2022/0268049 A1 Aug. 25, 2022

Related U.S. Application Data

(60) Provisional application No. 63/152,741, filed on Feb. 23, 2021.

(51) Int. Cl.
*E04H 12/22* (2006.01)
*A45B 23/00* (2006.01)

(52) U.S. Cl.
CPC ..... *E04H 12/2246* (2013.01); *A45B 23/00* (2013.01); *E04H 12/2269* (2013.01); *A45B 2023/0012* (2013.01); *A45B 2200/1063* (2013.01)

(58) Field of Classification Search
None
See application file for complete search history.

(56) References Cited

U.S. PATENT DOCUMENTS 3,119,588 A * 1/1964 Keats ..... E01F 9/688 40/607.04
5,271,196 A * 12/1993 Fanti ..... E04H 12/22 52/165
5,517,702 A * 5/1996 Fraher ..... E04H 4/108 248/161
6,305,659 B1 * 10/2001 Metelski ..... A61B 90/25 248/910
6,511,033 B2 * 1/2003 Li ..... A45B 23/00 248/519
6,637,717 B2 * 10/2003 Li ..... E04H 12/2238 135/20.3

(Continued)

FOREIGN PATENT DOCUMENTS

CA 2759944 A1 * 5/2013 ..... A45B 23/00
CN 205214462 U * 5/2016 ..... A45B 11/00

(Continued)

*Primary Examiner* — David R Dunn
*Assistant Examiner* — Danielle Jackson
(74) *Attorney, Agent, or Firm* — Argus Intellectual Enterprise, LLC; Jordan Sworen; Daniel Enea

(57) ABSTRACT

An umbrella base for supporting an umbrella within a pool, poolside, or other outdoor areas. The umbrella base apparatus includes a base assembly having a base tube that can removably receive the umbrella therein. The base assembly includes a plate that can rest on a flat surface, one or more support arms extending from a central area outward from the plate, and a collar that is generally positioned at the central area of the plate. Each support arm interlocks with the collar. One or more weighted housings engage with a support arm and collar for providing mass to the umbrella base apparatus during use. The weighted housings are removable during transport or during submerged use. The plate and support arms have apertures that allow water to pass through during movement through water.

19 Claims, 6 Drawing Sheets

(56) References Cited

U.S. PATENT DOCUMENTS

| | | | | |
|---|---|---|---|---|
| 7,614,600 | B1 * | 11/2009 | Smith | G09F 23/00 248/910 |
| 9,540,840 | B2 * | 1/2017 | Ma | F16M 13/00 |
| 9,974,369 | B1 * | 5/2018 | DePaolo | E04H 12/2246 |
| 10,813,425 | B2 * | 10/2020 | Shen | E04H 12/2238 |
| 10,925,360 | B1 * | 2/2021 | Schwiebert | A47C 13/00 |
| 11,377,866 | B1 * | 7/2022 | Conlon | A45B 23/00 |
| 11,408,192 | B2 * | 8/2022 | Schwiebert | A45B 23/00 |
| 2004/0069922 | A1 * | 4/2004 | Wu | E04H 12/2246 248/519 |
| 2013/0146739 | A1 * | 6/2013 | Zhao | E04H 12/2246 248/519 |

FOREIGN PATENT DOCUMENTS

| | | | | |
|---|---|---|---|---|
| DE | 19919142 | A1 * | 11/1999 | A45B 11/00 |
| GB | 2446859 | A * | 8/2008 | E04H 12/2246 |
| GB | 2463241 | A * | 3/2010 | E04H 12/2215 |
| WO | WO-2015125116 | A1 * | 8/2015 | E04H 12/2238 |
| WO | WO-2022039593 | A1 * | 2/2022 | |

* cited by examiner

UMBRELLA BASE APPARATUS

BACKGROUND OF THE INVENTION

The present invention relates to an umbrella base apparatus. The present invention further provides a base assembly adapted to removably couple with an elongated pole of the umbrella via a base tube, wherein the base is configured to support an umbrella within a pool, poolside, or other outdoor area.

Many people enjoy spending time outdoors in the sun, especially poolside or on the beach. Unfortunately, excessive sun exposure can be damaging to a person's health and wellbeing. This is especially true in certain regions with too much ultraviolet radiation. As a solution, people sit under umbrellas as a way to escape the sun. However, most umbrellas are unable to provide shade to people while in the pool.

There exist some poolside umbrellas that offer shade to the area in close proximity therewith, however, as the sun changes position in the sky, the effective shaded area also changes accordingly. This requires repositioning of the poolside umbrellas. Yet, these typical poolside umbrellas are not easily transportable between multiple locations, such as the beach or the park. Therefore, there exists a need for an umbrella that comprises a base configured to removably receive an umbrella, wherein the base is adapted to remain at bottom of a pool, poolside, or other outdoor area and is conveniently transportable.

Furthermore, in use, an umbrella is only suitable for one environment, i.e., placement in sand or atop a hard surface such as a patio deck. For example, a beach umbrella generally comprises a pointed or threaded end for insertion into the sand for support. A conventional poolside umbrella may utilize weighted bags or containers for securement to the patio in an erected configuration. However, these poolside umbrellas are not suitable for placement in different environments. Therefore, there exists a need for an umbrella that comprises a reconfigurable base that is adapted to remain at bottom of a pool and placement atop a patio deck.

In light of the devices disclosed in the known art, it is submitted that the present invention substantially diverges in design elements and methods from the known art and consequently it is clear that there is a need in the art for an improvement for an umbrella base apparatus. In this regard the instant invention substantially fulfills these needs.

SUMMARY OF THE INVENTION

In view of the foregoing disadvantages inherent in the known types of umbrella base apparatuses now present in the known art, the present invention provides a new umbrella base apparatuses wherein the same can be utilized for supporting an umbrella within a pool, poolside, or other outdoor areas.

It is an objective of the present invention to provide an umbrella base apparatus comprising a base assembly that can selectively engage with an elongated pole of an umbrella. The base assembly is adapted for use submerged within a pool and includes a plate for supporting the umbrella, wherein the plate comprises apertures for convenient transport through water.

It is another objective of the present invention to provide the umbrella base assembly for use on a pool deck or other generally flat surface. The base assembly is attachable to one or more weighted housings for holding the umbrella and base in place during use. Each weighted housing is securable to the base assembly via a hook that engages with a collar and support arms. The weighted housing as removable from the base assembly such that when the umbrella is being moved, the weighted housings do not add additional encumbrance during the transport.

It is yet another objective of the present invention to provide an umbrella base assembly having the collar and the one or more support arms that work cooperatively to secure the weighted housing thereto. The collar is interlocked with each of the support arms and secured to the plate. In this way, the base assembly is structurally strong while remaining light enough for transport.

It is yet another objective of the present invention to provide a weighted housing formed from a monolithic structure having an integrated handle and interior compartment, wherein interior compartment is adapted to be filled with fluid or sand for providing additional mass thereto. In some embodiments, the weighted housings correspond with the number of support arms so that the entire plate is covered by the weighted housings.

It is therefore an object of the present invention to provide a new and improved umbrella base apparatus that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for supporting an umbrella within a pool, poolside, or other outdoor areas. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. Additionally, "base", "base assembly", and "base apparatus" may be used interchangeably, and all refer to the support portion of the present invention that is adapted support the umbrella in an erect position.

Figure 1:
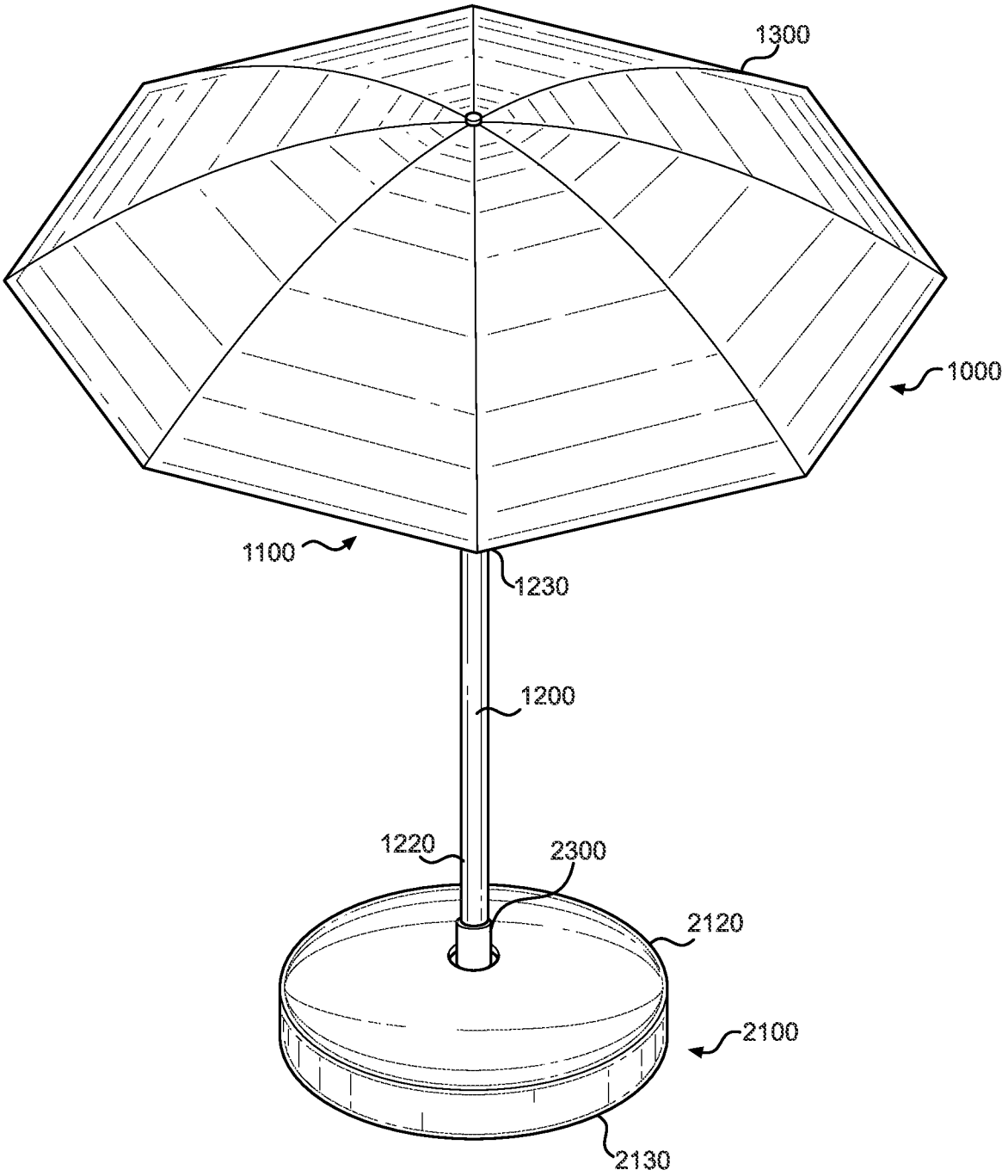
FIG. 1 shows a perspective view of an embodiment of the umbrella base apparatus.
Figure 2:
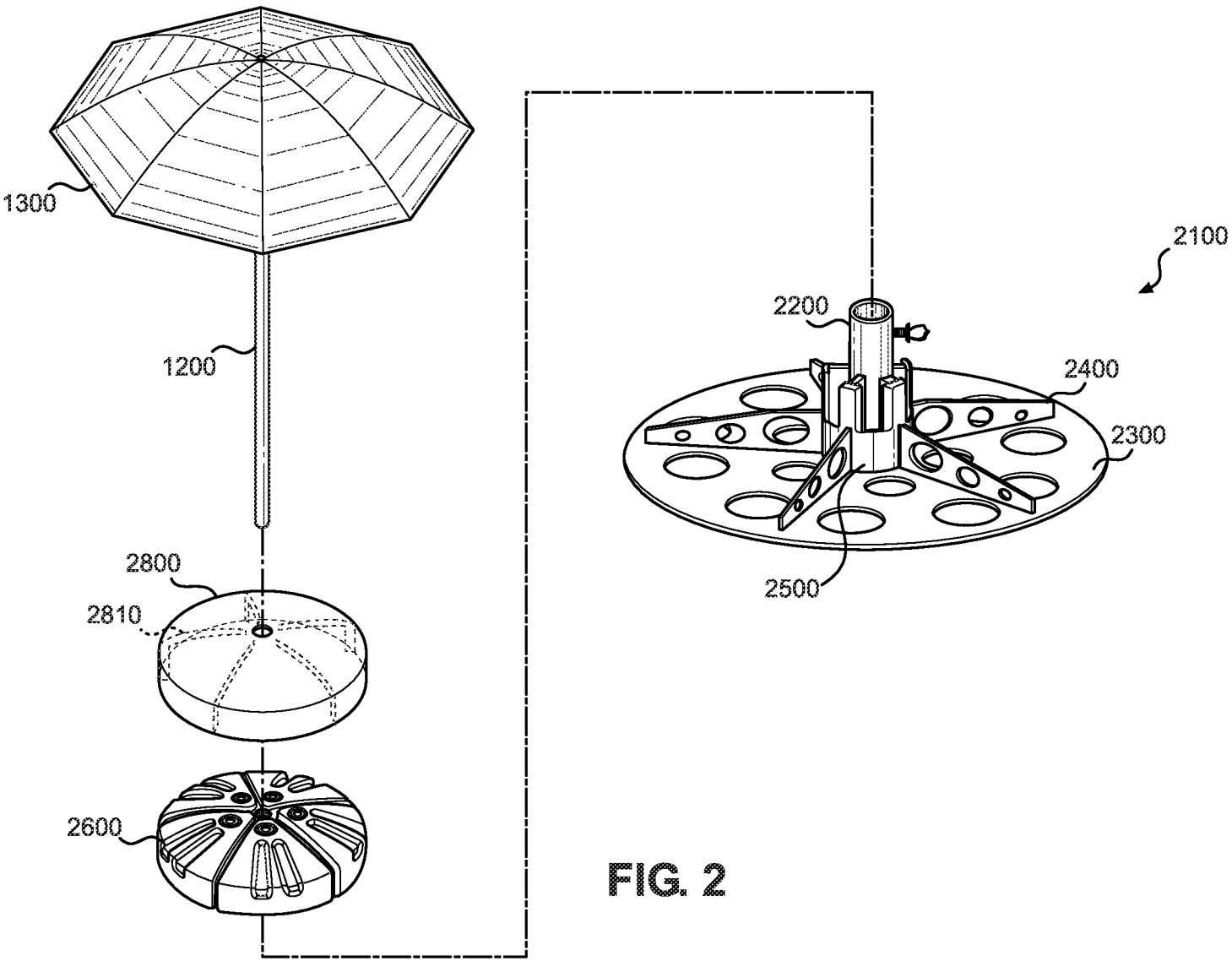
FIG. 2 shows an exploded view of an embodiment of the umbrella base apparatus.

Referring now to FIGS. 1 and 2, there is shown a perspective view and an exploded view of an embodiment of an umbrella base apparatus, respectively. The umbrella base apparatus 1000 is configured for providing shade to a user while the umbrella base apparatus is disposed above or below water. The umbrella base apparatus comprises a base assembly 2100 that is adapted to support an elongated pole 1200 of an umbrella 1100 via a base tube 2200. The base tube 2200 includes an elongated tubular member having a hollow interior that is sized to receive the elongated pole 1200 of the umbrella 1100. In this way, the elongated pole 1200 and base tube 2200 are coaxial and are generally aligned vertically and erect.

In the shown embodiment, the base assembly 2100 comprises a generally circular dome having the base tube 2200 extend from a central area on a first side 2120. The base assembly 2100 includes a flat second side 2130 opposite the first side 2120, such that the base assembly 2100 is supported on a generally horizontal surface, such as a pool patio or pool floor. In alternate embodiments, the flat second side comprises a textured surface or layer to provide friction configured to prevent the base assembly from sliding on a surface.

In the illustrated embodiment, the umbrella 1100 comprises the elongated pole 1200 having a first end 1220 adapted to removably couple with the base assembly 2100 and a canopy 1300 at a second end 1230, wherein the canopy 1300 is adapted to transition between an open configuration and a closed configuration. In an open configuration, as shown in FIG. 1, the canopy 1300 is expended to provide shade to the area beneath and in close proximity to the umbrella 1100. In the closed configuration, the canopy 1300 is retracted or otherwise closed to minimize the shadow formed by the canopy 1300. In some embodiments, the umbrella base apparatus does not include the umbrella and only includes the base assembly. In alternate embodiments, the umbrella base apparatus comprises the umbrella and base assembly.

Referring now to FIG. 2, the base assembly 2100 comprises a plate 2300, a plurality of support arms 2400, and a collar 2500. One or more weighted housings 2600 are sized to be received by the base assembly 2100 so as to be semi-permanently affixed therewith. Here, "semi-permanently" means coupled via a hook or other fastener but separable without the use of a tool. In the shown embodiment, the one or more weighted housings 2600 form a shape that covers the plate almost entirely, aside from gaps formed between each weighted housing. The plurality of support arms 2400 form sectors between adjacent support arms that receive a corresponding weighted housings 2600 therebetween.

In the illustrated embodiment, a cover 2800 is removably positioned over the weighted housings 2600 and assembled base assembly 2100. The cover 2800 is dome shaped and adapted to extend around a perimeter of the plate 2300 such that the weighted housings 2600 are inaccessible when the cover is positioned on the plate. The cover 2800 includes a central aperture that aligns with the elongated pole 1200 and base tube 2200, such that they are coaxial thereby allowing the insertion and removal of the elongated pole 1200 from the base tube 2200 when the cover 2800 is secured to the base assembly 2100.

In the illustrated embodiment, the cover 2800 comprises a cover retainer to prevent rotation of the cover 2800 when placed over the weighted housings 2600 and assembled base assembly 2100. In the shown embodiment, the cover retainer is a plurality of ribs 2810 that extend downward from the interior of the cover 2800. In some embodiments, the ribs 2810 extend from the the central aperture, along the upper interior wall of the cover 2800, and the interior sidewall thereof. The ribs 2810 are configured to align above each of the support arms 2400 such that a support arm 2400 and rib 2810 are disposed in a same vertical plane. The ribs 2810 prevent rotation of the cover 2800 by resting within the gaps formed between adjacent weighted housings, wherein the gaps are formed by the support arm extending upward from the plate.

Figure 3:
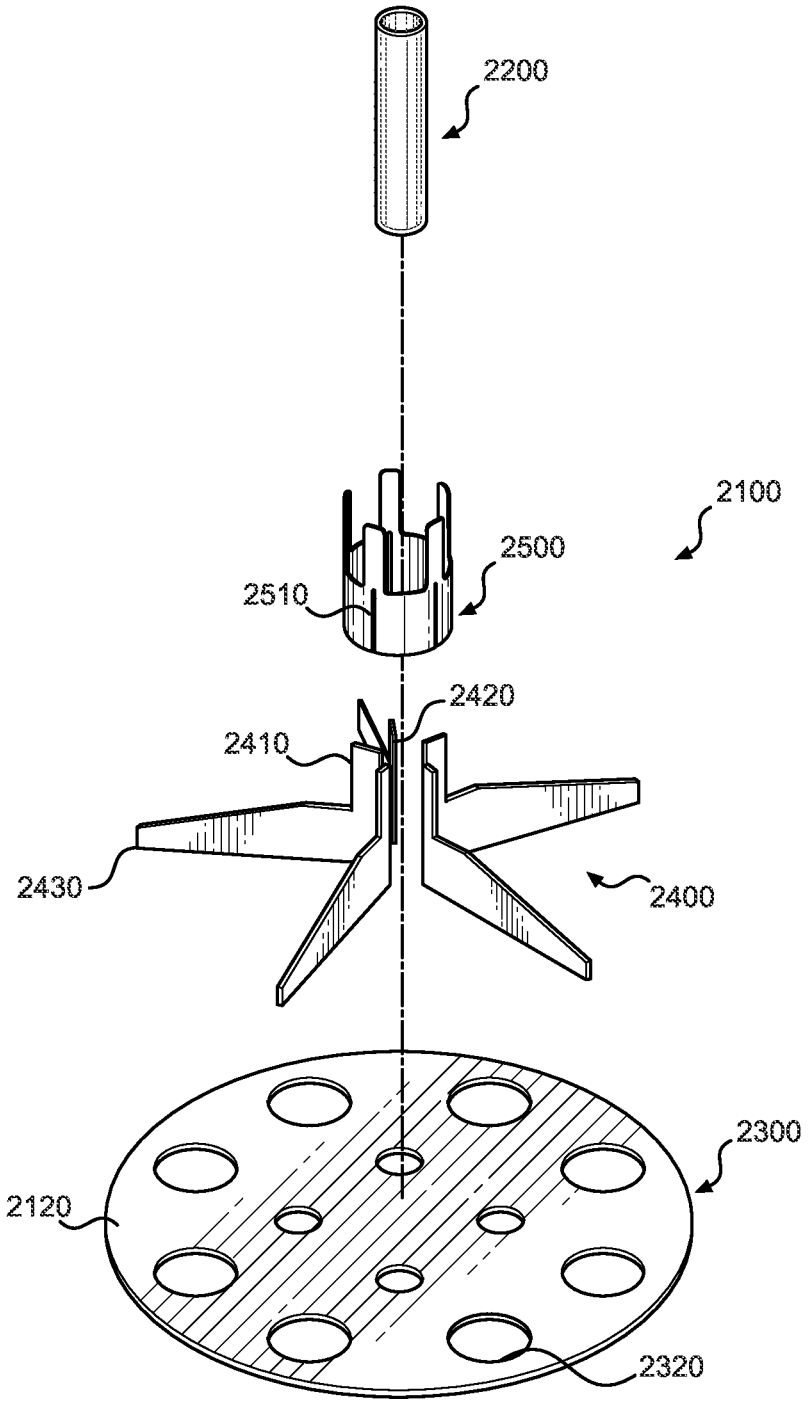
FIG. 3 shows an exploded view of an embodiment of the base assembly.

Referring now to FIG. 3, there is shown an exploded view of an embodiment of the base assembly. In the shown embodiment, the base assembly 2100 comprises the plate 2300, the one or more support arms 2400, the collar 2500, and the base tube 2200. In the illustrated embodiment, the plate 2300 is a planar member with the first side 2120 for supporting the other elements of the base assembly 2100. In the illustrated embodiment, the plate 2300 comprises a circular cross-sectional shape. However, in other embodiments, the plate comprises any suitable shape such as having a square or rectangular cross-sectional shape.

The plurality of support arms 2400 extend radially on the first side 2120 of the plate 2300 from a central position. In the shown embodiment, the plurality of support arms 2400 are spaced evenly thereabout, such that an angle formed between adjacent support arms 2400 are equivalent angles, approximately seventy-two-degree angles with five support arms. In the shown embodiment, each support arm of the plurality of support arms 2400 comprise a fin 2410 at a first end 2420 thereof, opposite a second end 2430 of the support arm. The fin 2410 is L-shaped and extends upward from the plate 2300 when the support arm 2400 is seated thereon. In the illustrated embodiment, the fin 2410 comprises a raised section that extends a greater distance from the plate 2300 than the second end 2430 of the support arm and is configured to rest within the collar 2500. In the illustrated embodiment, each support arm is disposed in a single plane. In the illustrated embodiment, each support arm tapers from the first end to the second end.

In the shown embodiment, the collar 2500 is mounted to the plate 2100 over the plurality of support arms 2400 via a plurality of corresponding slots 2510 on a lower end 2520 of the collar 2500 such that the fin 2410 of each plurality of support arms 2400 is positioned within the corresponding slots 2510. The collar 2500 is positioned centrally and includes a hollow interior that is sized to receive the base tube 2200 therein. The collar 2500 is adapted to be concentric with the base tube 2200 when both are fastened to the plate 2300. In some embodiments, the base tube 2200, support arms 2400, and the collar 2500 are fastened to the plate 2100 via a weld. In other embodiments, any suitable fastener is used to secure the base assembly together.

Figure 8:
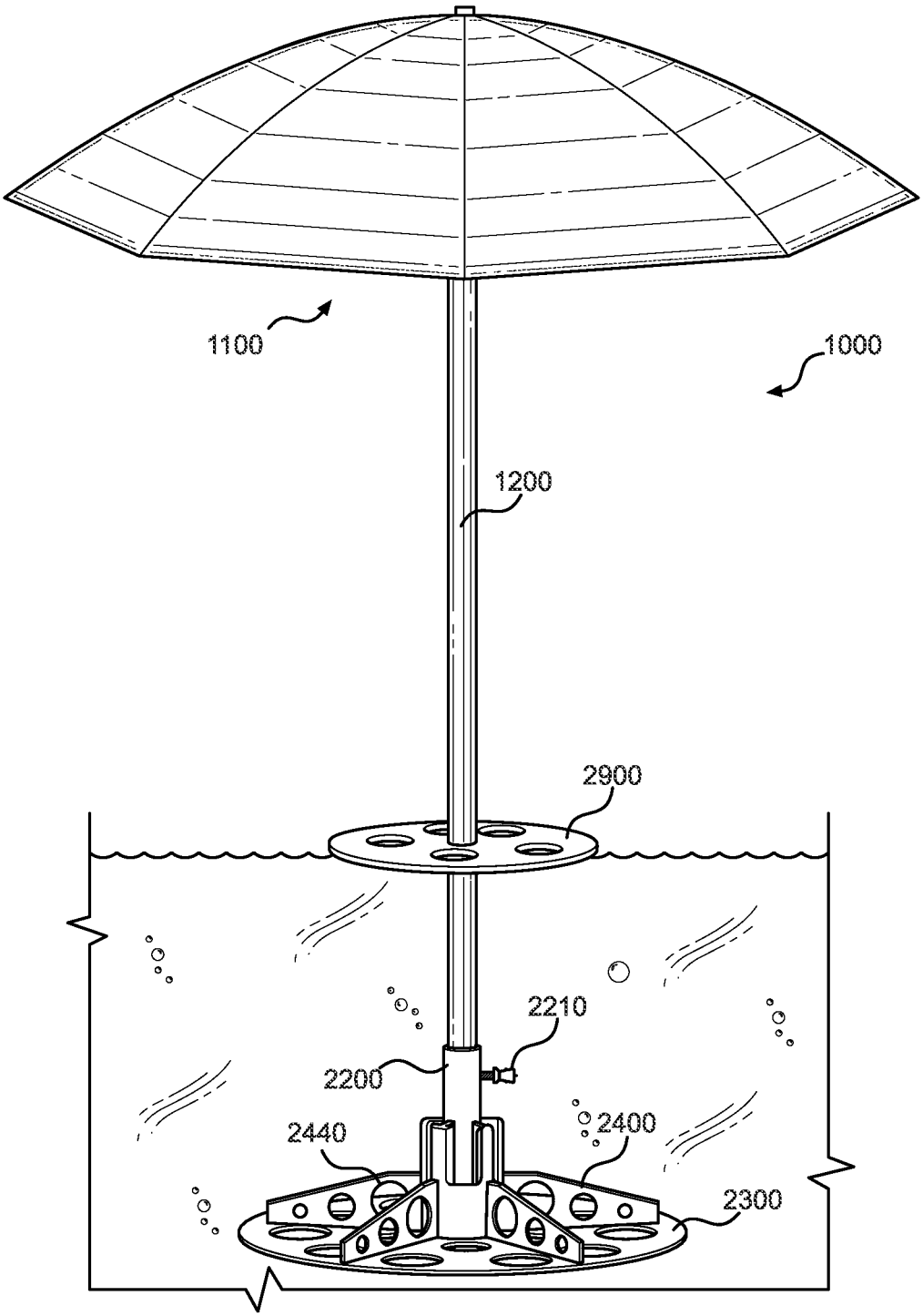
FIG. 8 shows a perspective view of the umbrella base apparatus in use such that the base assembly is submerged in a pool.

In the shown embodiment, the base assembly 2100 includes a plurality of apertures 2320 disposed throughout. The apertures 2320 are adapted to allow for water to pass therethrough when moving the base assembly 2100 through a submerged location. In the illustrated embodiment, the apertures 2320 comprise different diameters. In other embodiments, each aperture comprises a same diameter. In alternate embodiments, other elements of the base assembly include apertures, such as the support arms (as seen in FIG. 8) and collar, to allow water to flow therethrough.

Figure 4:
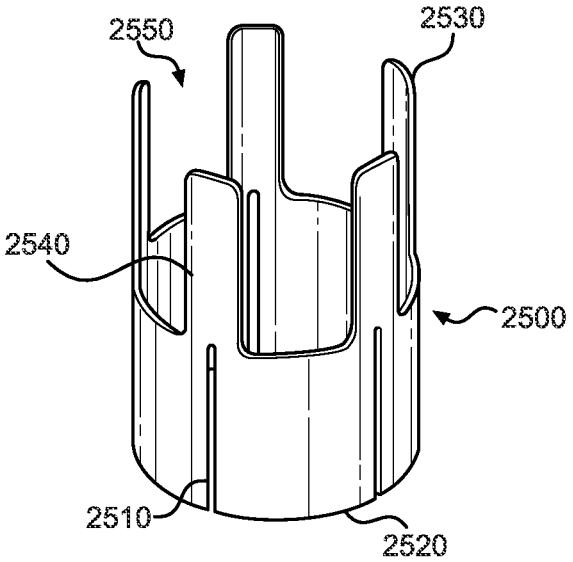
FIG. 4 shows a perspective view of an embodiment of the collar of the base apparatus.
Figure 5:
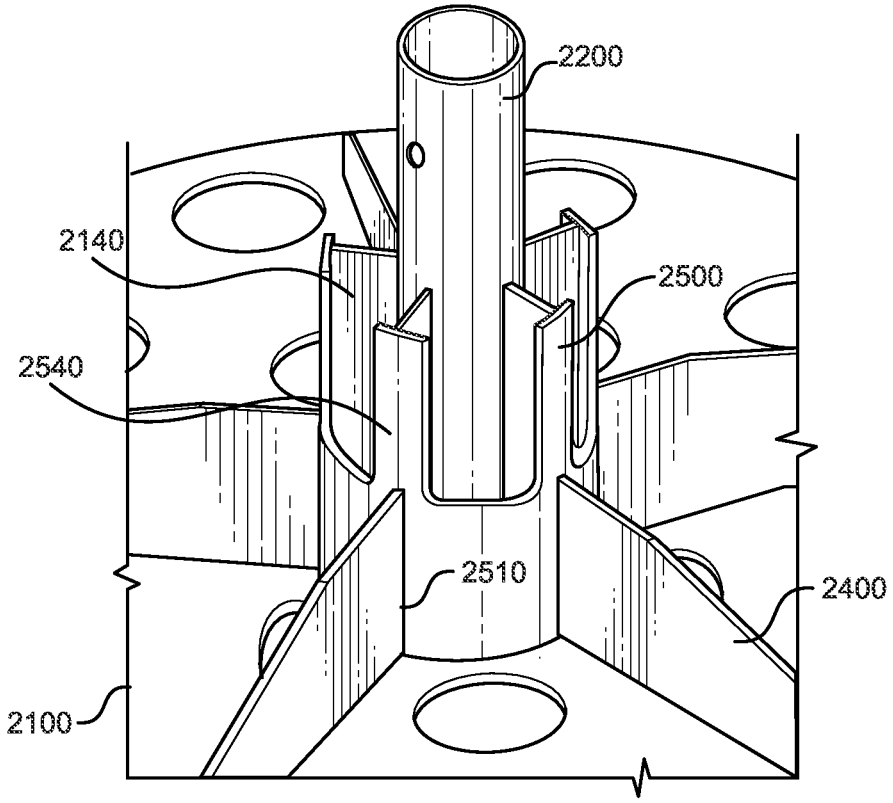
FIG. 5 shows a perspective view of an embodiment of the base assembly in an assembled position.

Referring to FIGS. 4 and 5, there is shown a perspective view of an embodiment of the collar of the base assembly and a perspective view of an embodiment of the base assembly in an assembled position, respectively. In the shown embodiment, the collar 2500 includes an upper end 2530 having a series of spaced apart vertical retaining plates 2540 that extend circumferentially thereabout, wherein adjacent retaining plates 2540 are separated from one another by a recess 2550. The retaining plates 2540 are coextensive with the collar 2500 at the lower end 2520 thereof. In the shown embodiment, the number of retaining plates 2540 are equivalent to the number of support arms 2400 and the number of weighted housings. The collar 2500 is adapted to mount to the plate 2100 over the plurality of support arms 2400 via the plurality of corresponding slots 2510. The slots 2510 are aligned beneath with the retaining plates 2540. In this way, when the support arm 2400 interlocks with the collar 2500 via the slots 2510, the fin 2410 and the retaining plate 2540 terminate at the upper end 2530 to form a flush end. The fin 2410 and the retaining plate 2540 form a "T" shape such that the fin 2410 abuts a central position of the retaining plate 2540 and extends perpendicularly thereto. In the illustrated embodiment, each fin 2410 also abuts the base tube 2200 when received within the collar 2500.

Figure 6:
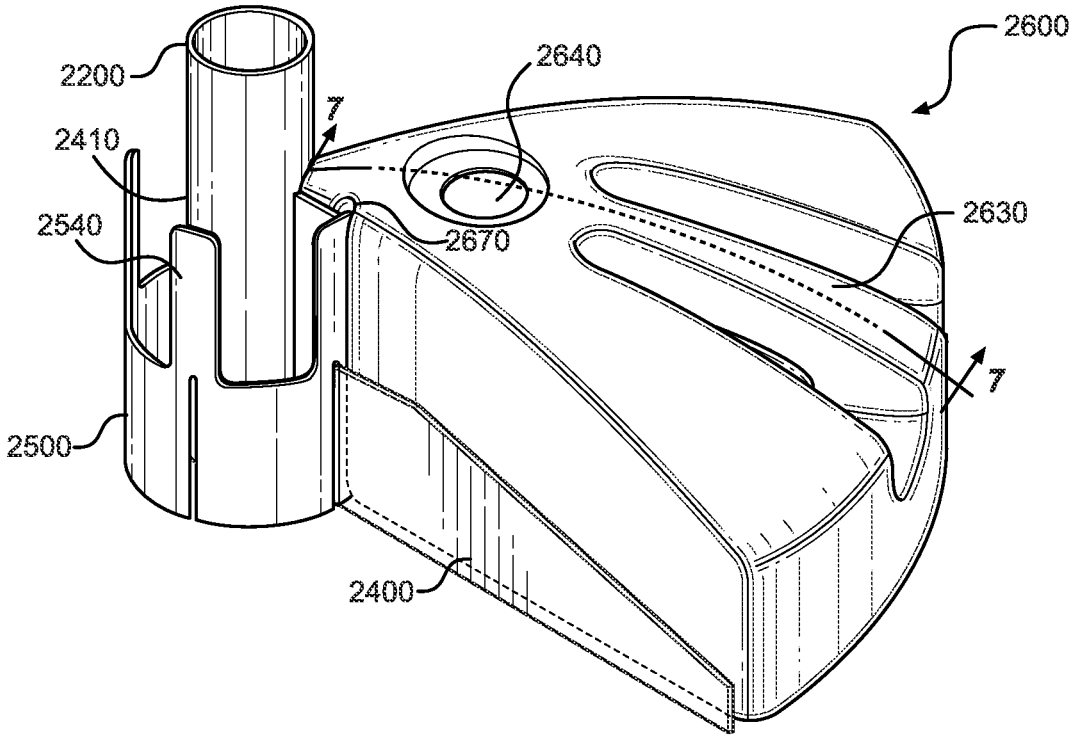
FIG. 6 shows a perspective view of an embodiment of a single weighted housings coupled with the assembled base assembly.
Figure 7:
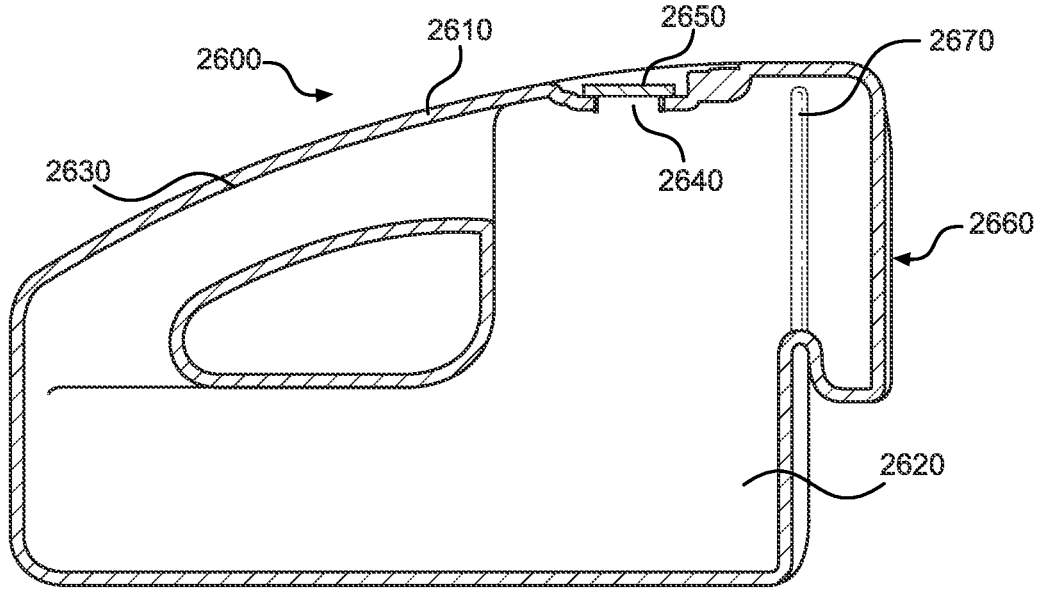
FIG. 7 shows a cross sectional view of an embodiment of the weighted housings taken along line 7-7 of FIG. 6.

Referring to FIGS. 6 and 7, there is shown a perspective view of an embodiment of a single weighted housing coupled with the assembled base assembly and a cross sectional view of an embodiment of the weighted housings taken along line 7-7 of FIG. 6, respectively. In the shown embodiment, the plurality of weighted housings 2600 are sized to be seated between adjacent support arms 2400 in the assembled configuration, wherein the plurality of weighted housings 2600 form sectors about the base tube 2200. In the illustrated embodiment, each weighted housing 2600 comprises an outer shell 2610 forming a compartment 2620 adapted to store a weighted object such as fluid or sand. A handle 2630 is formed by the shell 2610 for grasping each weighted housing 2600. An opening 2640 is positioned at an upper end of the shell 2610, wherein the opening 2640 in fluid communication with the compartment 2620. A cap 2650 for selectively closing the opening is removably affixed to the opening 2640. In alternate embodiments, the weighted housing is entirely enclosed and includes the weighted object disposed within the shell, wherein the weighted object is inaccessible by the user and unable to be removed.

In the illustrated embodiment, each weighted housing is secured to the base assembly via a hook 2660. The hook 2660 is formed by the shell 2610 which is adapted to be seated over the collar 2500 and received by the recess 2550 of the collar 2500 for semi-permanent fastening. In the illustrated embodiment, a channel 2670 is disposed on a lateral side of the shell 2610 and is sized to interlock with one or more of the retaining plates 2540 of the collar 2500. When the hook 2660 and channel 2670 is engaged with the collar 2500 and retaining plates 2540, respectively, the weighted housing 2600 is secured to the collar 2500. In one embodiment, the adjacent fins 2410 abut a corresponding weighted housing 2600 to laterally position to each sector when mounted to the collar 2500 via the hook 2660. In alternate embodiments, the weighted housing is semi-permanently attached to the collar or other parts of the base assembly by any suitable fastener, such as a magnet, male and female engagement, and the like. In other embodiments, the weighted housing is configured to remain on the plate while in-use due to only the mass of the weighted housing.

Referring to FIG. 8, there is shown a perspective view of the umbrella base apparatus in use such that the base assembly is submerged in a pool. In the shown embodiment, the umbrella and base assembly 1000 are positioned within a pool such that the plate 2300 is supported on the pool floor. The umbrella and base assembly 1000 can be used within a pool with or without the weighted housing 2600. When the umbrella and base assembly 1000 are being repositioned within the pool or removed from the pool, the weighted housings 2600 can be removed individually to expose the apertures of the plate.

In the shown embodiment, the cover and weighted housings are removed from the plate 2300. The umbrella 1100 is secured to the base assembly 2100 via the elongated pole 1200 engaging with the base tube 2200. The base tube 2200 comprises a fastener 2210 extending through a lateral channel for frictionally engaging the pole 1200 with the base assembly 2100 via the fastener 2210. Each of the plurality of support arms 2400 comprises a plurality of apertures 2440, the apertures 2440 adapted to allow for water to pass therethrough when moving the base through the submerged location. In some embodiments, a pole mounted table 2900 is positioned along a longitudinal length of the elongated pole to support drinks, plates, and the like thereon. In some embodiments, the pole mounted table 2900 is adapted to float at the water surface.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella base apparatus, comprising:

a base assembly adapted to removably couple with an elongated pole of an umbrella via a base tube;

wherein in an assembled configuration, the base assembly comprises:

a plate having a plurality of support arms extending on a first side of the plate, each of the plurality of support arms extend radially from a central position and comprise a fin at a first end thereof;

wherein the fin extends upward from the plate when the support arm is seated thereon;

a collar adapted to mount to the plate over the plurality of support arms via a plurality of corresponding slots on a lower end of the collar such that the fin of each plurality of support arms is positioned within the corresponding slot;

wherein the base tube is seated within the collar and the plurality of support arms;

a plurality of weighted housings sized to be seated between adjacent support arms in the assembled configuration, wherein the plurality of weighted housings form sectors about the base tube.

2. The umbrella base apparatus of claim 1, wherein an upper end of the collar comprises a series of spaced apart retaining plates that extend circumferentially thereabout, the series of retaining plates separated by recesses.

3. The umbrella base apparatus of claim 2, wherein each weighted housing comprises a channel sized to interlock with a retaining plate of the plurality of retaining plates of the collar.

4. The umbrella base apparatus of claim 2, wherein each weighted housing comprises:

an outer shell forming a compartment adapted to store a weighted object;

an opening and a cap for selectively closing the opening, the opening in fluid communication with the compartment;

a hook formed by the shell adapted to be seated over the collar;

a channel sized to interlock with one or more of the retaining plates of the collar.

5. The umbrella base apparatus of claim 4, wherein each weighted housing further comprises a handle formed by the shell for grasping each weighted housing.

6. The umbrella base apparatus of claim 5, wherein the shell is a monolithic structure, and the handle is accessible from depressions in the shell positioned on either side thereof.

7. The umbrella base apparatus of claim 1, further comprising a cover adapted to secure over the plurality of weighted housings to cover the first side of the plate.

8. The umbrella base apparatus of claim 1, wherein each weighted housing is distinct from each other.

9. The umbrella base apparatus of claim 1, wherein adjacent fins abut a corresponding weighted housing disposed therebetween to laterally position the weighted housing when mounted to the base assembly.

10. The umbrella base apparatus of claim 1, wherein the plate comprises a plurality of apertures, the apertures adapted to allow for water to pass therethrough when moving the base assembly through a submerged location.

11. The umbrella base apparatus of claim 10, wherein each of the plurality of support arms comprises a plurality of apertures, the apertures adapted to allow for water to pass therethrough when moving the base assembly through a submerged location.

12. The umbrella base apparatus of claim 1, wherein the base tube comprises a fastener extending through a lateral channel adapted to secure the elongated pole with the base assembly via the fastener.

13. The umbrella base apparatus of claim 1, wherein the plate is circular and each of the weighted housings having a curved distal end corresponding to a perimeter of the plate.

14. The umbrella base apparatus of claim 1, further comprising the umbrella having the elongated pole, wherein the elongated pole comprises a first end adapted to removably couple with the base assembly and a canopy at a second end, wherein the canopy is adapted to transition between an open configuration and a closed configuration.

15. An umbrella base apparatus, comprising:

a plate having a collar on a first side of the plate;

a base tube adapted to removably couple with an elongated pole of an umbrella, wherein the base tube is seated within the collar;

a plurality of weighted housings sized to be seated on the collar, wherein the plurality of weighted housings form sectors about the base tube;

a plurality of support arms extending on the first side of the plate, each of the plurality of support arms extend radially from a central position and comprise a fin at a first end thereof;

the collar adapted to mount to the plate over the plurality of support arms via a plurality of corresponding slots on a lower end of the collar such that the fin of each plurality of support arms is positioned within the corresponding slot.

16. The umbrella base apparatus of claim 15, wherein an upper end of the collar comprises a series of spaced apart vertical retaining plates that extend circumferentially thereabout, the series of retaining plates separated by recesses.

17. The umbrella base apparatus of claim 16, wherein each weighted housing comprises:

an outer shell forming a compartment adapted to store a weighted object such as fluid or sand;

a handle formed by the shell for grasping each weighted housing;

an opening at an upper end and a cap for selectively closing the opening, the opening in fluid communication with the compartment;

a hook formed by the shell adapted to be seated over the collar;

a channel sized to interlock with one or more of the retaining plates of the collar.

18. The umbrella base apparatus of claim 17, further comprising a cover adapted to secure over the plurality of weighted housings to cover the first side of the plate, wherein the cover comprises an aperture for receiving the elongated shaft of the umbrella therethrough.

19. The umbrella base apparatus of claim 18, wherein the plate comprises a plurality of apertures, the apertures adapted to allow for water to pass therethrough when moving the plate through a submerged location.

* * * * *